US009217117B2

(12) United States Patent
Chahine et al.

(10) Patent No.: US 9,217,117 B2
(45) **Date of Patent: *Dec. 22, 2015**

(54) FRICTION MODIFIER AND THEIR USE IN LUBRICANTS AND FUELS

(71) Applicant: CASTROL LIMITED, Wiltshire (GB)

(72) Inventors: Samir Chahine, Berkshire (GB); James Edward Moss, Berkshire (GB)

(73) Assignee: CASTROL LIMITED, Reading (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/409,552

(22) PCT Filed: May 17, 2013

(86) PCT No.: PCT/EP2013/060258

§ 371 (c)(1),
(2) Date: Dec. 19, 2014

(87) PCT Pub. No.: WO2013/189675

PCT Pub. Date: Dec. 27, 2013

(65) Prior Publication Data

US 2015/0218479 A1 Aug. 6, 2015

(30) Foreign Application Priority Data

Jun. 20, 2012 (EP) ..... 12004646

(51) Int. Cl.

| | |
|---|---|
| ***C10L 1/22*** | (2006.01) |
| ***C10L 1/14*** | (2006.01) |
| ***C10M 105/36*** | (2006.01) |
| ***C10M 173/02*** | (2006.01) |
| ***C10L 10/08*** | (2006.01) |
| ***C10L 1/222*** | (2006.01) |
| ***C10M 133/06*** | (2006.01) |

(52) U.S. Cl.

CPC ..... *C10L 10/08* (2013.01); *C10L 1/222* (2013.01); *C10L 1/2222* (2013.01); *C10M 133/06* (2013.01); *C10L 2200/0259* (2013.01); *C10L 2270/023* (2013.01); *C10L 2270/026* (2013.01); *C10M 2203/1025* (2013.01); *C10M 2207/026* (2013.01); *C10M 2207/028* (2013.01); *C10M 2215/04* (2013.01); *C10M 2215/26* (2013.01); *C10M 2219/046* (2013.01); *C10M 2223/045* (2013.01); *C10N 2230/02* (2013.01); *C10N 2230/06* (2013.01); *C10N 2230/42* (2013.01)

(58) Field of Classification Search

CPC ..... C10M 2207/125; C10M 2207/282; C10M 2215/042; C10M 2215/04

USPC ..... 508/459, 496, 500, 513; 44/391

See application file for complete search history.

(56) References Cited

U.S. PATENT DOCUMENTS

| | | | | |
|---|---|---|---|---|
| 3,926,581 | A | 12/1975 | Plonsker | |
| 2005/0198894 | A1 * | 9/2005 | Migdal et al. | 44/388 |
| 2010/0093573 | A1 | 4/2010 | Kocsis et al. | |

FOREIGN PATENT DOCUMENTS

| | | | |
|---|---|---|---|
| DE | 26 45 235 | A1 | 4/1978 |
| DE | 26 45 2355 | A1 | 4/1978 |

OTHER PUBLICATIONS

PubChem Open Chemistry Database, Substance Record for SID 24868097, Sigma-Aldrich, Jul. 12, 2007.*

PubChem Open Chemistry Databases, Substance Record for SID 24873439, Sigma-Aldrich, Jul. 12, 2007.*

PCT International Preliminary Report on Patentability, International Application No. PCT/EP2013/060258, International Filing Date May 17, 2013, mailed Dec. 31, 2014 (7 pages).

* cited by examiner

*Primary Examiner* — Vishal Vasisth

(74) *Attorney, Agent, or Firm* — Nixon & Vanderhye P.C.

(57) ABSTRACT

A non-aqueous lubricating composition containing a major amount of an oil of lubricating viscosity and a minor amount, in the range of 0.02% to 5% by weight, of at least one compound represented by the structural formula (I):

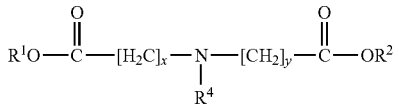

(I)

wherein $R^4$ represents H or a $C_1$ to $C_9$ hydrocarbyl group or

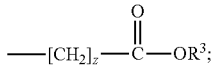

x, y and z are independently integers in the range 1 to 6; and $R^1$, $R^2$ and $R^3$ each independently represent a $C_1$ to $C_{10}$ hydrocarbyl or substituted hydrocarbyl group.

21 Claims, No Drawings

FRICTION MODIFIER AND THEIR USE IN LUBRICANTS AND FUELS

This application is the U.S. national phase of International Application No. PCT/EP2013/060258 filed May 17, 2013 which designated the U.S. and claims priority to European Patent Application No. 12004646.1 filed Jun. 20, 2012, the entire contents of each of which are hereby incorporated by reference.

This invention relates to anti-wear additives and their use in non-aqueous lubricating compositions and/or in fuel compositions.

It is known to use anti-wear additives in lubricating compositions. It is also known to use anti-wear additives in fuel compositions, for example in liquid fuel compositions for internal combustion engines.

US patent application publication US 2010/0093573 relates to a lubricating composition containing an oil of lubricating viscosity, an amine-containing friction modifier, and an ashless antiwear agent. It is stated in paragraph [0001] that the lubricating composition is suitable for lubricating and internal combustion engine. It is stated in paragraphs [016] to [0025] that the ashless anti-wear agent is represented by the Formula (I):

Formula (1)

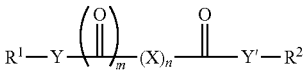

wherein:

Y and Y' are independently —O—, >NH, >$NR^3$, or an imide group formed by taking together both Y and Y' and forming a $R^1$—N< group between two >C═O groups;

X is independently —Z—O—Z'—, >$CH_2$, >$CHR^4$, >$CR^4R^5$, >C(OH)($CO_2R^2$), >C($CO_2R^2$)$_2$; >$CH_2CO_2R^2$ or >$CHOR^6$;

Z and Z' are independently >$CH_2$, >$CHR^4$ or >$CR^4R^5$, >C(OH)($CO_2R^2$), or >$CHOR^6$;

n is 0 to 10, or 1 to 8, or 1 to 6, or 2 to 6, or 2 to 4, with the proviso that when n=1, X is not >$CH_2$, and when n=2, both X's are not simultaneously >$CH_2$;

m is 0 or 1;

$R^1$ is independently hydrogen or a hydrocarbyl group, typically containing 1 to 150, 4 to 30, or 6 to 20, or 10 to 20, or 11 to 18 carbon atoms, with the proviso that when $R^1$ is hydrogen, m is 0, and n is more than or equal to 1;

$R^2$ is a hydrocarbyl group, typically containing 1 to 150, 4 to 30, or 6 to 20, or 10 to 20, or 11 to 18 carbon atoms;

$R^3$, $R^4$ and $R^5$ are independently hydrocarbyl groups or hydroxy-containing hydrocarbyl groups or carboxyl-containing hydrocarbyl groups; and $R^6$ is hydrogen or a hydrocarbyl group, typically containing 1 to 150, or 4 to 30 carbon atoms.

US patent application publication US 2010/0190669 relates to a method of lubricating an aluminium silicate composite surface with a lubricant comprising ashless, sulphur-free, phosphorous-free anti-wear agent. It is stated in paragraphs [0028] to [0036] that the ashless anti-wear agent is represented in one embodiment by the Formula (1a) and/or Formula (1b):

Formula (1a)

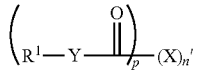

Formula (1b)

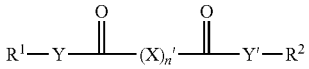

wherein:

n' is 0 to 10, 0 to 6, 0 to 4, 1 to 4, or 1 to 2 for Formula (1b), and 1 to 10, 1 to 4, or 1 to 2 for Formula (1a);

p is 1 to 5, or 1 to 2, or 1;

Y and Y' are independently —O—, >NH, >$NR^3$, or an imide group formed by taking together both Y and Y' groups in (1b) or two Y groups in (1a) and forming a $R^1$—N< group between two >C═O groups;

X is independently —$CH_2$—, >$CHR^4$ or >$CR^4R^5$, >$CHOR^6$, or >C($CO_2R^6$)$_2$, >C($OR^6$)$CO_2R^6$, >C($CH^2OR^6$)$CO_2R^6$, —$CH_3$, —$CH_2R^4$ or —$CHR^4R^5$, —$CH_2OR^6$, or —CH($CO_2R^6$)$_2$, ═C—$R^6$, or mixtures thereof to fulfill the valence of Formula (1a) and/or (1b), with the proviso that ═C—$R^6$ only applies to Formula (1a), the ═C referring to three single bonds to the carbon atom;

$R^1$ and $R^2$ are independently hydrocarbyl groups, typically containing 1 to 150, 4 to 30, or 6 to 20, or 10 to 20, or 11 to 18 carbon atoms;

$R^3$ is a hydrocarbyl group;

$R^4$ and $R^5$ are independently keto-containing groups (such as acyl groups), ester groups or hydrocarbyl groups; and $R^6$ is independently hydrogen or a hydrocarbyl group, typically containing 1 to 150, or 4 to 30 carbon atoms.

US patent application publication US 2010/0197536 relates, in particular at paragraphs [0016] to [0025], to a lubricating composition comprising an oil of lubricating viscosity, an oil soluble molybdenum compound and an ashless antiwear agent represented by the Formula (1):

Formula (1)

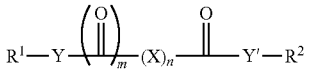

wherein:

Y and Y' are independently —O—, >NH, >$NR^3$, or an imide group formed by taking together both Y and Y' and forming a $R^1$—N< group between two >C═O groups;

X is independently —Z—O—Z'—, >$CH_2$, >$CHR^4$ or >$CR^4R^5$, >C(OH)($CO_2R^2$), >C($CO_2R^2$)$_2$, >$CCH_2CO_3R^2$, or >$CHOR^6$;

Z and Z' are independently >$CH_2$, >$CHR^4$ or >$CR^4R^5$, >C(OH)($CO_2R^2$), or >$CHOR^6$;

n is 0 to 10, or 1 to 8, or 1 to 6, or 2 to 6, or 2 to 4, with the proviso that when n=1, X is not >$CH_2$, and when n=2, both X's are not simultaneously >$CH_2$;

m is 0 or 1;

$R^1$ is independently hydrogen or a hydrocarbyl group, typically containing 1 to 150, 4 to 30, or 6 to 20, or 10 to 20, or 11 to 18, or 8 to 10 carbon atoms, with the proviso that when $R^1$ is hydrogen, m is 0, and n is more than or equal to 1;

$R^2$ is a hydrocarbyl group, typically containing 1 to 150, 4 to 30, or 6 to 20, or 10 to 20, or 11 to 18, or 8 to 10 carbon atoms;

$R^3$, $R^4$ and $R^5$ are independently hydrocarbyl groups or hydroxy-containing hydrocarbyl groups or carboxyl-containing hydrocarbyl groups; and $R^6$ is hydrogen or a hydrocarbyl group, typically containing 1 to 150, or 4 to 30 carbon atoms.

There remains a need for an ashless anti-wear additive for use in a non-aqueous lubricating composition and/or in a fuel composition. Ashless means that the anti-wear additive does not contain any metallic components.

It has now been found that certain secondary or tertiary amine esters exhibit anti-wear benefits for example when used in a non-aqueous lubricating composition (for example, in a non-aqueous lubricating composition for lubricating internal combustion engines) and/or in a fuel composition (for example, in a liquid fuel composition for internal combustion engines).

Thus, according to an aspect of the present invention there is provided the use as an ashless anti-wear additive in a non-aqueous lubricating composition and/or in a fuel composition, of at least one compound represented by the structural formula (I):

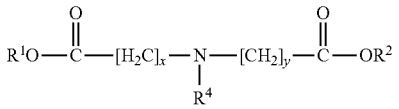

(I)

wherein $R^4$ represents H or a $C_1$ to $C_9$ hydrocarbyl group or

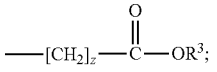

x, y and z are independently integers in the range 1 to 6; and $R^1$, $R^2$ and $R^3$ each independently represent H or a $C_1$ to $C_{10}$ hydrocarbyl or substituted hydrocarbyl group.

The compound represented by structural formula (I) is used as an ashless anti-wear additive in a non-aqueous lubricating composition in an amount in the range of 0.02% to 5% by weight.

The compound represented by structural formula (I) is used as an ashless anti-wear additive in a fuel composition for an internal combustion engine at a concentration of up to 500 ppm by weight.

Thus, according to an aspect of the present invention there is provided a non-aqueous lubricating composition comprising a major amount of an oil of lubricating viscosity and a minor amount, in the range of 0.02% to 5% by weight, of at least one compound represented by the structural formula (I):

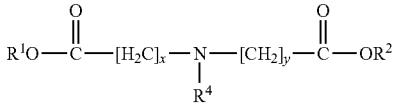

(I)

wherein $R^4$ represents H or a $C_1$ to $C_9$ hydrocarbyl group or

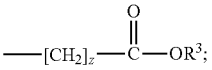

x, y and z are independently integers in the range 1 to 6; and $R^1$, $R^2$ and $R^3$ each independently represent a $C_1$ to $C_{10}$ hydrocarbyl or substituted hydrocarbyl group.

The lubricating composition may be used to lubricate an internal combustion engine. The lubricating composition may be used to lubricate the crankcase of an internal combustion engine. The internal combustion engine may be used in an automotive application. The internal combustion engine may be used in a marine application and/or in a land-based power generation plant.

The lubricating composition may be used to lubricate the cylinder (also called combustion chamber) of an internal combustion engine. Thus for example, the lubricating composition may be a cylinder lubricating composition (sometimes also called a cylinder oil). The lubricating composition may be a cylinder oil which may be used to lubricate the cylinder of a two-stroke diesel crosshead engine which may be used for example, in a marine application and/or in a land-based power generation plant.

According to another aspect of the present invention, there is provided a method of lubricating an internal combustion engine which method comprises supplying to the engine an oil of lubricating viscosity and at least one compound one compound represented by the structural formula (I):

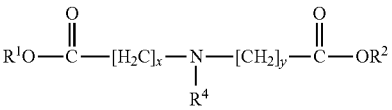

(I)

wherein $R^4$ represents H or a $C_1$ to $C_9$ hydrocarbyl group or

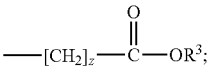

x, y and z are independently integers in the range 1 to 6; and $R^1$, $R^2$ and $R^3$ each independently represent H or a $C_1$ to $C_{10}$ hydrocarbyl or substituted hydrocarbyl group.

Suitably, the internal engine is lubricated with a lubricating composition according to the present invention.

The oil of lubricating viscosity and at the least one compound represented by the structural formula (I) may be supplied to the crankcase of the internal combustion engine in which embodiment, the internal combustion engine may be used for example, in an automotive application and/or the internal combustion engine may be used in a marine application and/or in a land-based power generation plant.

Additionally or alternatively, the oil of lubricating viscosity and at the least one compound represented by the structural formula (I) may be supplied to the combustion chamber or cylinder of the internal combustion engine in which embodiment the internal combustion engine may be for example, a two-stroke diesel crosshead engine which may be used for example in a marine application and/or in a land-based power generation plant. In a two-stroke engine which has a split lubrication system the compound represented by the structural formula (I) may thus be supplied to the crankcase lubricant (sometimes called system oil) and/or supplied to the cylinder oil.

Additionally or alternatively, the compound represented by the structural formula (I) may be provided in a liquid fuel composition used to operate the internal combustion engine and during operation of the engine at least a portion of the compound ingresses into a lubricating composition comprising an oil of lubricating viscosity, while the lubricating composition is used to lubricate the engine, for example as a crankcase lubricating composition.

According to another aspect of the present invention there is provided a method of improving the anti-wear properties of an oil of lubricating viscosity which method comprises admixing said oil with an effective amount in the range of 0.02% to 5% by weight of at least one compound represented by the structural formula (I):

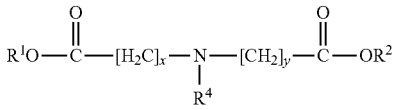

(I)

wherein $R^4$ represents H or a $C_1$ to $C_9$ hydrocarbyl group or

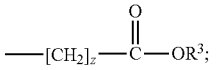

x, y and z are independently integers in the range 1 to 6; and $R^1$, $R^2$ and $R^3$ each independently represent H or a $C_1$ to $C_{10}$ hydrocarbyl or substituted hydrocarbyl group.

According to another aspect of the present invention there is provided a method of preparing a non-aqueous lubricating composition which method comprises admixing an oil of lubricating viscosity with an effective amount in the range of 0.02% to 5% by weight of at least one compound represented by the structural formula (I):

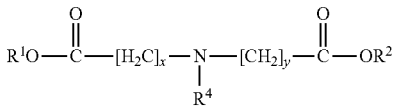

(I)

wherein $R^4$ represents H or a $C_1$ to $C_9$ hydrocarbyl group or

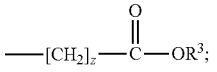

x, y and z are independently integers in the range 1 to 6; and $R^1$, $R^2$ and $R^3$ each independently represent H or a $C_1$ to $C_{10}$ hydrocarbyl or substituted hydrocarbyl group.

According to another aspect of the present invention there is provided an additive concentrate for a non-aqueous lubricating composition comprising:

(i) at least one compound represented by the structural formula (I):

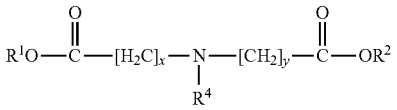

(I)

wherein $R^4$ represents H or a $C_1$ to $C_9$ hydrocarbyl group or

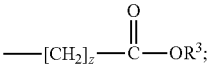

x, y and z are independently integers in the range 1 to 6; and $R^1$, $R^2$ and $R^3$ each independently represent H or a $C_1$ to $C_{10}$ hydrocarbyl or substituted hydrocarbyl group and (ii) at least one other lubricant additive.

The additive concentrate may be used in the method of improving the anti-wear properties of an oil of lubricating viscosity. The additive concentrate may be used in the method of preparing a lubricating composition.

According to another aspect of the present invention, there is provided a fuel composition for an internal combustion engine which composition comprises a major amount of a liquid fuel and a minor amount at a concentration of up to 500 ppm by weight of at least one compound represented by the structural formula (I):

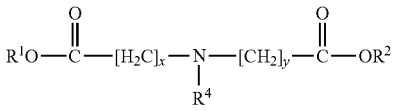

(I)

wherein $R^4$ represents H or a $C_1$ to $C_9$ hydrocarbyl group or

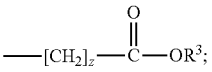

x, y and z are independently integers in the range 1 to 6; and $R^1$, $R^2$ and $R^3$ each independently represent a $C_1$ to $C_{10}$ hydrocarbyl or substituted hydrocarbyl group.

In at least some embodiments the fuel composition is a fuel composition for a compression ignition internal combustion engine. In at least some embodiments the fuel composition is a fuel composition for a spark ignition internal combustion engine which composition is free of added methyl cyclopentadienyl manganese tricarbonyl and in which in formula (I) $R^1$, $R^2$ and $R^3$ each independently represent a methyl, ethyl, n-propyl, isopropyl, n-butyl, iso-butyl or tert-butyl group or a $C_1$ to $C_{10}$ substituted hydrocarbyl group.

According to another aspect of the present invention there is provided a method of improving the anti-wear properties of a liquid fuel, which method comprises admixing said liquid fuel with an effective amount at a concentration of up to 500 ppm by weight of at least one compound represented by the structural formula (I):

(I)

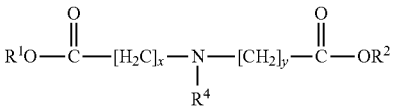

wherein $R^4$ represents H or a $C_1$ to $C_9$ hydrocarbyl group or

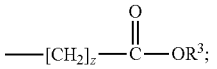

x, y and z are independently integers in the range 1 to 6; and $R^1$, $R^2$ and $R^3$ each independently represent H or a $C_1$ to $C_{10}$ hydrocarbyl or substituted hydrocarbyl group.

According to another aspect of the present invention there is provided a method of preparing a fuel composition for an internal combustion engine, which method comprises admixing a liquid fuel with an effective amount at a concentration of up to 500 ppm by weight of at least one compound represented by the structural formula (I):

(I)

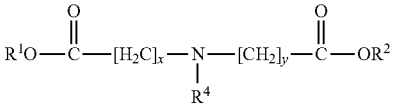

wherein $R^4$ represents H or a $C_1$ to $C_9$ hydrocarbyl group or

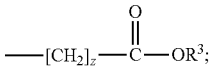

x, y and z are independently integers in the range 1 to 6; and $R^1$, $R^2$ and $R^3$ each independently represent H or a $C_1$ to $C_{10}$ hydrocarbyl or substituted hydrocarbyl group.

In at least some embodiments the fuel composition is a fuel composition for a compression ignition internal combustion engine in which in formula (I) $R^1$, $R^2$ and $R^3$ each independently represent a $C_1$ to $C_{10}$ hydrocarbyl or substituted hydrocarbyl group.

In at least some embodiments the fuel composition is a fuel composition for a spark ignition internal combustion engine which composition is free of added methyl cyclopentadienyl manganese tricarbonyl and in which in formula (I) $R^1$, $R^2$ and $R^3$ each independently represent a methyl, ethyl, n-propyl, iso-propyl, n-butyl, iso-butyl or tert-butyl group or a $C_1$ to $C_{10}$ substituted hydrocarbyl group.

According to another aspect of the present invention there is provided an additive concentrate for a fuel composition for an internal combustion engine, which composition comprises (a) at least one compound represented by the structural formula (I):

(I)

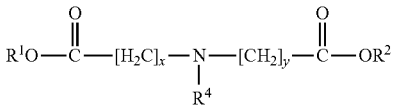

wherein $R^4$ represents H or a $C_1$ to $C_9$ hydrocarbyl group or

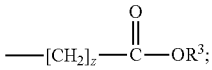

x, y and z are independently integers in the range 1 to 6; and $R^1$, $R^2$ and $R^3$ each independently represent H or a $C_1$ to $C_{10}$ hydrocarbyl or substituted hydrocarbyl group and (b) at least one other fuel additive.

In at least some embodiments the fuel composition is a fuel composition for a compression ignition internal combustion engine in which in formula (I) $R^1$, $R^2$ and $R^3$ each independently represent a $C_1$ to $C_{10}$ hydrocarbyl or substituted hydrocarbyl group.

In at least some embodiments the fuel composition is a fuel composition for a spark ignition internal combustion engine which composition is free of added methyl cyclopentadienyl manganese tricarbonyl and in which in formula (I) $R^1$, $R^2$ and $R^3$ each independently represent a methyl, ethyl, n-propyl, iso-propyl, n-butyl, iso-butyl or tert-butyl group or a $C_1$ to $C_{10}$ substituted hydrocarbyl group.

The additive concentrate may be used in the method of improving the anti-wear properties of a liquid fuel. The additive concentrate may be used in the method of preparing a fuel composition.

According to yet a further aspect of the present invention there is provide a method of operating an internal combustion engine which method comprises supplying to the engine a liquid fuel, an oil of lubricating viscosity and at least one compound represented by the structural formula (I):

(I)

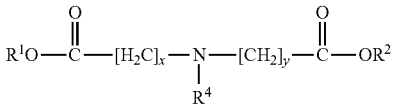

wherein $R^4$ represents H or a $C_1$ to $C_9$ hydrocarbyl group or

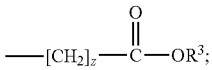

x, y and z are independently integers in the range 1 to 6; and $R^1$, $R^2$ and $R^3$ each independently represent H or a $C_1$ to $C_{10}$ hydrocarbyl or substituted hydrocarbyl group.

The compound of formula (I) may be supplied to the engine in admixture with the liquid fuel and/or with the oil of lubricating viscosity.

The compound represented by the structural formula (I) as herein defined has been found to exhibit anti-wear performance. Therefore, according to at least one embodiment of the present invention there is provided, the use as an ashless anti-wear additive in a non-aqueous lubricating composition, in an amount in the range of 0.02% to 5% by weight, and/or in a fuel composition for an internal combustion engine at a concentration of up to 500 ppm by weight, of at least one compound represented by the structural formula (I):

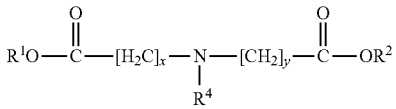

(I)

wherein $R^4$ represents H or a $C_1$ to $C_9$ hydrocarbyl group or

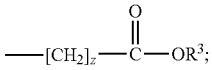

x, y and z are independently integers in the range 1 to 6; and $R^1$, $R^2$ and $R^3$ each independently represent H or a $C_1$ to $C_{10}$ hydrocarbyl or substituted hydrocarbyl group.

The present invention solves the technical problem defined above by the use as an ashless anti-wear additive in a non-aqueous lubricating composition in an amount in the range of 0.02% to 5% by weight, and/or in a fuel composition for an internal combustion engine at a concentration of up to 500 ppm by weight, of at least one compound represented by the structural formula (I):

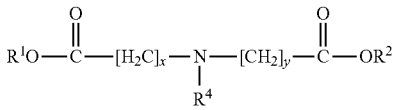

(I)

wherein $R^4$ represents H or a $C_1$ to $C_9$ hydrocarbyl group or

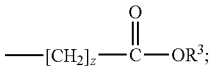

x, y and z are independently integers in the range 1 to 6; and $R^1$, $R^2$ and $R^3$ each independently represent H or a $C_1$ to $C_{10}$ hydrocarbyl or substituted hydrocarbyl group.

The use may be in any of the embodiments of the present invention including: the non-aqueous lubricating composition, the method of lubricating an internal combustion engine, the method of improving the anti-wear properties of an oil of lubricating viscosity, the method of preparing a non-aqueous lubricating composition, the additive concentrate for a non-aqueous lubricating composition, the fuel composition (for example for an internal combustion, engine), the method of improving the anti-wear properties of a liquid fuel, the method of preparing a fuel composition for an internal combustion engine, the additive concentrate for a fuel composition for an internal combustion engine and the method of operating an internal combustion engine.

In another aspect, the present invention provides the use as an ashless anti-wear additive in a non-aqueous lubricating composition, in an amount in the range of 0.02% to 5% by weight, and/or in a fuel composition for an internal combustion engine at a concentration of up to 500 ppm by weight, of at least one compound represented by the structural formula (I):

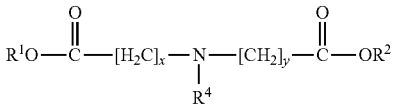

(I)

wherein $R^4$ represents H or a $C_1$ to $C_9$ hydrocarbyl group or

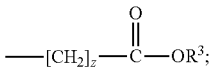

x, y and z are independently integers in the range 1 to 6; and $R^1$, $R^2$ and $R^3$ each independently represent H or a $C_1$ to $C_{10}$ hydrocarbyl or substituted hydrocarbyl group.

Ashless means that the anti-wear additive does not contain any metallic components.

Suitably, in structural formula (I), x, y and z may be independently integers in the range 1 to 3 and more suitably are 1 or 2. The integers x, y and z may each be 1. Suitably, the integers x, y, and z are all 1.

In structural formula (I) 'hydrocarbyl group' means a group comprising carbon and hydrogen and which group is connected to the rest of the molecule through at least one carbon atom. A substituted hydrocarbyl group is a hydrocarbyl group which additionally comprises one or more heteroatoms, for example oxygen and/or nitrogen. The hydrocarbyl or substituted hydrocarbyl group may be straight chain or branched chain. The hydrocarbyl or substituted hydrocarbyl group may be saturated or unsaturated. The hydrocarbyl or substituted hydrocarbyl group may be aliphatic, alicylic or aromatic. The hydrocarbyl or substituted hydrocarbyl group may be heterocyclic. In the use of the present invention, in structural formula (I), $R^1$, $R^2$ and $R^3$ may each independently represent H, that is a hydrogen moiety. In some examples, in structural formula (I), $R^1$, $R^2$ and $R^3$ each independently represent a saturated hydrocarbyl group. In some examples, $R^1$, $R^2$ and $R^3$ each independently represent a methyl, ethyl, n-propyl, iso-propyl, n-butyl, iso-butyl or tert-butyl group. Suitably, $R^1$ $R^2$ and $R^3$ each independently represent an ethyl or tert-butyl group.

In some examples, in structural formula (I), $R^1$, $R^2$ and $R^3$ each independently represent an unsaturated hydrocarbyl group.

In some examples, in structural formula (I), $R^1$ $R^2$ and $R^3$ each independently represent a substituted hydrocarbyl group comprising at least one heteroatom which is selected from the group consisting of nitrogen, oxygen and combinations thereof.

In some examples, in structural formula (I), $R^4$ represents H.

In some examples, in structural formula (I), $R^4$ represents H; x=y=1; and $R^1$ and $R^2$ each independently represent an ethyl or tert-butyl group.

In some examples, in structural formula (I), $R^4$ represents H; x=y=1; and $R^1$ and $R^2$ each represent an ethyl group.

In some examples, in structural formula (I), $R^4$ represents H; x=y=1; and $R^1$ and $R^2$ each represent a tert-butyl group.

In some examples, in structural formula (I), $R^4$ represents a methyl group.

In some examples, in structural formula (I), $R^4$ represents a $C_1$ to $C_9$ substituted hydrocarbyl group comprising at least one heteroatom which is selected from the group consisting of nitrogen, oxygen and combinations thereof.

In some examples, in structural formula (I), x=y=1, $R^1$ and $R^2$ each represent an ethyl group and $R^4$ represents:

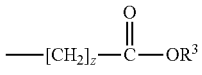

wherein z=1 and $R^3$ represents $—C_2H_5$.

Suitable compounds represented by structural formula (I) include:

- di-ethyliminodiacetate (reference AW1) which is a compound represented by structural formula (I) in which x=y=1, $R^1$ and $R^2$ each represent an ethyl group and $R^4$ represents H;
- di-tert-butyliminodiacetate (reference AW2) which is a compound represented by structural formula (I) in which x=y=1, $R^1$ and $R^2$ each represent a tert-butyl group and $R^4$ represents H;
- triethyliminotriacetate (reference AW3) (also called triethyl 2,2',2"-nitrilotriacetate) which is a compound represented by structural formula (I) in x=y=1, $R^1$ and $R^2$ each represent an ethyl group and $R^4$ represents:

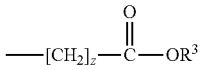

wherein z=1 and $R^3$ represents an ethyl group; and

- diethyl(imino-methyl)diacetate (reference AW4) which is a compound represented by structural formula (I) in which x=y=1, $R^1$ and $R^2$ each represent an ethyl group and $R^4$ represents methyl.

Lubricating Compositions and Additive Concentrates for Lubricating Compositions.

According to an aspect of the present invention there is provided a non-aqueous lubricating composition comprising a major amount of an oil of lubricating viscosity and a minor amount, in the range of 0.02% to 5% by weight, of at least one compound represented by the structural formula (I) in which $R^1$ $R^2$ and $R^3$ each independently represent a $C_1$ to $C_{10}$ hydrocarbyl or substituted hydrocarbyl group.

According to at least one aspect of the present invention the amount of the compound represented by structural formula (I) in the lubricating composition is in the range of 0.02% to 5% by weight, for example in the range of 0.1 to 2.5% by weight.

The concentration of the compound represented by structural formula (I) in the additive concentrate may be an amount suitable to provide the required concentration when used in the lubricating composition. In at least some examples, the additive concentrate is used in a lubricating composition in an amount of 0.5 to 30% by weight. Therefore, the amount of the compound represented by structural formula (I) and any other additives in the lubricant concentrate may be more concentrated than that in the lubricating composition, for example by a factor of from 1:0.005 to 1:0.30.

The lubricating composition comprises a major amount of oil of lubricating viscosity and a minor amount of the compound represented by structural formula (I). Major amount means greater than 50% and minor amount means less than 50% by weight.

In at least some examples, the lubricating composition and the oil of lubricating viscosity comprise base oil. Base oil comprises at least one base stock. In at least some examples, the oil of lubricating composition comprises one or more additives other than the compound represented by structural formula (I). Suitably, the lubricating composition and/or the oil of lubricating viscosity comprises base oil in an amount of from greater than 50% to about 99.5% by weight, for example from about 85% to about 95% by weight.

The base stocks may be defined as Group I, II, III, IV and V base stocks according to API standard 1509, "ENGINE OIL LICENSING AND CERTIFICATION SYSTEM", April 2007 version 16$^{th}$ edition Appendix E, as set out in Table 1.

Group I, Group II and Group III base stocks may be derived from mineral oils Group I base stocks are typically manufactured by known processes comprising solvent extraction and solvent dewaxing, or solvent extraction and catalytic dewaxing. Group II and Group III base stocks are typically manufactured by known processes comprising catalytic hydrogenation and/or catalytic hydrocracking, and catalytic hydroisomerisation. A suitable Group I base stock is AP/E core 150, available from ExxonMobil. Suitable Group II basestocks are EHC 50 and EHC 110, available from ExxonMobil. Suitable group III base stocks include Yubase 4 and Yubase 6 available for example, from SK Lubricants. Suitable Group V base stocks are ester base stocks, for example Priolube 3970, available from Croda International plc. Suitable Group IV base stocks include hydrogenated oligomers of alpha olefins. Suitably, the oligomers may be made by free radical processes, Zeigler catalysis or by cationic Friedel-Crafts catalysis. Polyalpha olefin base stocks may be derived from C8, C10, C12, C14 olefins and mixtures of one or more thereof.

TABLE 1

| Group | Saturated hydrocarbon content (% by weight) ASTM D2007 | | Sulphur content (% by weight) ASTM D2622 or D4294 or D4927 or D3120 | | Viscosity Index ASTM D2270 |
|---|---|---|---|---|---|
| I | <90 | and/or | >0.03 | and | ≥80 and <120 |
| II | ≥90 | and | ≤0.03 | and | ≥80 and <120 |
| III | ≥90 | and | ≤0.03 | and | ≥120 |
| IV | polyalpha olefins | | | | |
| V | all base stocks not in Groups I, II, III or IV | | | | |

In at least some examples the lubricating composition and the oil of lubricating viscosity comprise one or more base oil and/or base stock which is/are natural oil, mineral oil (sometimes called petroleum-derived oil or petroleum-derived mineral oil), non-mineral oil and mixtures thereof. Natural oils include animal oils, fish oils, and vegetable oils. Mineral oils include paraffinic oils, naphthenic oils and paraffinic-naphthenic oils. Mineral oils may also include oils derived from coal or shale.

Suitable base oils and base stocks oils include those derived from processes such as chemical combination of simpler or smaller molecules into larger or more complex molecules (for example polymerisation, oligomerisation, condensation, alkylation, acylation).

Suitable base stocks and base oils include those derived from gas-to-liquids materials, coal-to-liquids materials, biomass-to-liquids materials and combinations thereof.

Gas-to-liquids (sometimes also referred to as GTL materials) may be obtained by one or more process steps of synthesis, combination, transformation, rearrangement, degradation and combinations of two or more thereof applied to gaseous carbon-containing compounds. GTL derived base stocks and base oils may be obtained from the Fischer-Tropsch synthesis process in which synthesis gas comprising a mixture of hydrogen and carbon monoxide is catalytically converted to hydrocarbons, usually waxy hydrocarbons that are generally converted to lower-boiling materials hydroisomerisation and/or dewaxing (see for example, WO 2008/124191).

Biomass-to-liquids (sometimes also referred to as BTL materials) may be manufactured from compounds of plant origin for example by hydrogenation of carboxylic acids or triglycerides to produce linear paraffins, followed by hydroisomerisation to produced branched paraffins (see for example, WO-2007-068799-A).

Coal-to-liquids materials may be made by gasifying coal to make synthesis gas which is then converted to hydrocarbons.

In at least some examples the base oil and/or oil of lubricating viscosity have a kinematic viscosity at 100° C. in the range of 2 to 100 cSt, suitably in the range of 3 to 50 cSt and more suitably in the range 3.5 to 25 cSt.

In at least some examples the lubricating composition according to the present invention is a monograde lubricating oil composition according to the API classification, for example an SAE 20, 30, 40, 50 or 60 grade.

In at least some examples the lubricating composition according to an aspect of the present invention is a multigrade lubricating oil composition according to the API classification xW-y where x is 0, 5, 10, 15 or 20 and y is 20, 30, 40, 50 or 60 as defined by SAE J300 2004, for example 5W-20, 5W-30, 0W-20. In at least some examples the lubricating composition has an HTHS viscosity at 150° C. of at least 2.6 cP, for example as measured according to ASTM D4683, CEC L-36-A-90 or ASTM D5481.

In at least some examples the lubricating composition has an HTHS viscosity at 150° C. according to ASTM D4683 of from 1 to <2.6 cP, for example 1.8 cP.

The lubricating composition may be prepared by admixing an oil of lubricating viscosity with an effective amount of the compound represented by structural formula (I) together with optionally at least one other lubricant additive.

The method of preparing a lubricating composition and the method of improving the anti-wear properties of an oil of lubricating viscosity comprise admixing an oil of lubricating viscosity with an effective amount of the at least one compound represented by the structural formula (I).

In at least some examples the oil of lubricating viscosity is admixed with the compound represented by structural formula (I) in one or more steps by methods known in the art. In at least some examples the compound represented by structural formula (I) is admixed as one or more additive concentrates or part additive package concentrates, optionally comprising solvent or diluent. In at least some examples the oil of lubricating viscosity is prepared by admixing in one or more steps by methods known in the art, one or more base oils and/or base stocks optionally with one or more additives and/or part additive package concentrates. In at least some examples the compounds represented by structural formula (I), additive concentrates and/or part additive package concentrates are admixed with oil of lubricating viscosity or components thereof in one or more steps by methods known in the art.

In at least some examples the lubricating composition and the additive concentrate for a lubricating composition further comprise at least one other additive. In at least some examples the at least one other additive is multi-functional i.e. it performs more than one function in the composition.

Other Anti-Wear Additives

In at least some examples the lubricating composition and the additive concentrate for a lubricating composition further comprise at least one anti-wear additive other than the compound represented by structural formula (I). Such other anti-wear additives include those that are ash-producing additives or ashless additives. Examples of such other anti-wear additives include non-phosphorus containing additives for example, sulphurised olefins. Examples of such other anti-wear additives also include phosphorus-containing antiwear additives. Examples of suitable ashless phosphorus-containing anti-wear additives include trilauryl phosphite and triphenylphosphorothionate and those disclosed in paragraph [0036] of US2005/0198894. Examples of suitable ash-forming, phosphorus-containing anti-wear additives include dihydrocarbyl dithiophosphate metal salts. Examples of suitable metals of the dihydrocarbyl dithiophosphate metal salts include alkali and alkaline earth metals, aluminium, lead, tin, molybdenum, manganese, nickel, copper and zinc. Particularly suitable dihydrocarbyl dithiophosphate metal salts are zinc dihydrocarbyl dithiophosphates (ZDDP). The ZDDP's may have hydrocarbyl groups independently having 1 to 18 carbon atoms, suitably 2 to 13 carbon atoms or 3 to 18 carbon atoms, more suitably 2 to 12 carbon atoms or 3 to 13 carbon atoms, for example 3 to 8 carbon atoms. Examples of suitable hydrocarbyl groups include alkyl, cycloalkyl and alkaryl groups which may contain ether or ester linkages and also which may contain substituent groups for example, halogen or nitro groups. The hydrocarbyl groups may be alkyl groups which are linear and/or branched and suitably may have from 3 to 8 carbon atoms. Particularly suitable ZDDP's have hydrocarbyl groups which are a mixture of secondary alky groups and primary alkyl groups for example, 90 mol. % secondary alkyl groups and 10 mol. % primary alkyl groups.

The compound represented by structural formula (I) may reduce the amount of phosphorus- and/or zinc-containing anti-wear additive which might be required to achieve a desired amount of anti-wear properties for the non-aqueous lubricating composition.

In at least some examples phosphorus-containing anti-wear additives are present in the lubricating composition at a concentration of 10 to 6000 ppm by weight of phosphorus, suitably 10 to 1000 ppm by weight of phosphorus, for example 200 to 1400 ppm by weight of phosphorus, or 200 to 800 ppm by weight of phosphorus or 200 to 600 ppm by weight of phosphorus.

It has been found that the presence in a lubricating composition of a compound represented by structural formula (I) may assist in the performance of anti-wear additives, for example, zinc dihydrocarbyl dithiophosphate additives. This may have one or more of the following advantages:

This may have an advantage of reducing or even eliminating the amount of metals, for example zinc, or other ash-forming elements present in the lubricating composition. The compound represented by structural formula (I) may be used in a lubricating composition which does not contain any zinc. The compound represented by structural formula (I) may be used in a lubricating composition which is substantially free of any added zinc.

This may have an advantage of reducing or even eliminating the amount of phosphorus-containing anti-wear additives in the lubricating composition which in turn may reduce the amount of phosphorus in the exhaust emissions when the lubricating composition is used to lubricate an internal combustion engine. The reduction in the amount of phosphorus in the exhaust emissions may have benefits for any exhaust after treatment system.

This may have an advantage of reducing or even eliminating the amount of sulphur-containing anti-wear additives in the lubricating composition which in turn may reduce the amount of sulphur in the exhaust emissions when the lubricating composition is used to lubricate an internal combustion engine. The reduction in the amount of sulphur in the exhaust emissions may have benefits for any exhaust after treatment system.

The compound represented by structural formula (I) may be used in a lubricating composition which comprises reduced amounts of zinc dihydrocarbyl dithiophosphate additives. The compound represented by structural formula (I) may be used in a lubricating composition which comprises reduced amounts of added zinc dihydrocarbyl dithiophosphate additives.

In at least some examples the compound represented by structural formula (I) is used in a lubricating composition which does not contain any zinc dihydrocarbyl dithiophosphate additives. In at least some examples the compound represented by structural formula (I) is used in a lubricating composition which is substantially free of any added zinc dihydrocarbyl dithiophosphate additives.

Friction Modifiers.

In at least some examples the lubricating composition and the additive concentrate for a lubricating composition comprise at least one friction modifier. Examples of such friction modifiers include those that are ash-producing additives or ashless additives. Examples of such friction modifiers include fatty acid derivatives including for example, other fatty acid esters, amides, amines, and ethoxylated amines. Examples of suitable ester friction modifiers include esters of glycerol for example, mono-, di-, and tri-oleates, mono-palmitates and mono-myristates. A particularly suitable fatty acid ester friction modifier is glycerol monooleate. Examples of friction modifiers also include molybdenum compounds for example, organo molybdenum compounds, molybdenum dialkyldithiocarbamates, molybdenum dialkylthiophosphates, molybdenum disulphide, tri-molybdenum cluster dialkyldithiocarbamates, non-sulphur molybdenum compounds and the like. Suitable molybdenum-containing compounds are described for example, in EP-1533362-A1 for example in paragraphs [0101] to [0117].

Friction modifiers may also include a combination of an alkoxylated hydrocarbyl amine and a polyol partial ester of a saturated or unsaturated fatty acid or a mixture of such esters, for example as described in WO 93/21288.

Friction modifiers which are fatty acid derivative friction modifiers may be present in the lubricating oil composition at a concentration of 0.01 to 5% by weight actives, more suitably in the range of 0.01 to 1.5% by weight actives.

Molybdenum containing friction modifiers may be present in the lubricating oil composition at a concentration of 10 to 1000 ppm by weight molybdenum, more suitably in the range of 400 to 600 ppm by weight.

Other Additives.

The lubricating composition and the additive concentrate for a lubricating composition may also comprise other additives. Examples of such other additives include dispersants (metallic and non-metallic), dispersant viscosity modifiers, detergents (metallic and non-metallic), viscosity index improvers, viscosity modifiers, pour point depressants, rust inhibitors, corrosion inhibitors, antioxidants (sometimes also called oxidation inhibitors), anti-foams (sometimes also called anti-foaming agents), seal swell agents (sometimes also called seal compatibility agents), extreme pressure additives (metallic, non-metallic, phosphorus containing, non-phosphorus containing, sulphur containing and non-sulphur containing), surfactants, demulsifiers, anti-seizure agents, wax modifiers, lubricity agents, anti-staining agents, chromophoric agents and metal deactivators.

Dispersants

Dispersants (also called dispersant additives) help hold solid and liquid contaminants for example resulting from oxidation of the lubricating composition during use, in suspension and thus reduce sludge flocculation, precipitation and/or deposition for example on lubricated surfaces. They generally comprise long-chain hydrocarbons, to promote oil-solubility, and a polar head capable of associating with material to be dispersed. Examples of suitable dispersants include oil soluble polymeric hydrocarbyl backbones each having one or more functional groups which are capable of associating with particles to be dispersed. The functional groups may be amine, alcohol, amine-alcohol, amide or ester groups. The functional groups may be attached to the hydrocarbyl backbone through bridging groups. More than one dispersant may be present in the additive concentrate and/or lubricating composition.

Examples of suitable ashless dispersants include oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; Mannich condensation products formed by condensing a long chain substituted phenol with formaldehyde and polyalkylene polyamine; Koch reaction products and the like. Examples of suitable dispersants include derivatives of long chain hydrocarbyl-substituted carboxylic acids, for example in which the hydrocarbyl group has a number average molecular weight of up to 20000, for example 300 to 20000, 500 to 10000, 700 to 5000 or less than 15000. Examples of suitable dispersants include hydrocarbyl-substituted succinic acid compounds, for example succinimide, succinate esters or succinate ester amides and in particular, polyisobutenyl succinimide dispersants. The dispersants may be borated or non-borated. A suitable dispersant is ADX 222.

Dispersant Viscosity Modifiers.

Additionally or alternatively, dispersancy may be provided by polymeric compounds capable of providing viscosity index improving properties and dispersancy. Such compounds are generally known as dispersant viscosity improver additives or multifunctional viscosity improvers. Examples of suitable dispersant viscosity modifiers may be prepared by chemically attaching functional moieties (for example amines, alcohols and amides) to polymers which tend to have number average molecular weights of at least 15000, for example in the range 20000 to 600000 (for example as determined by gel permeation chromatography or light scattering methods). Examples of suitable dispersant viscosity modifiers and methods of making them are described in WO 99/21902, WO2003/099890 and WO2006/099250. More than one dispersant viscosity modifier may be present in the additive concentrate and/or lubricating composition.

Detergents

Detergents (also called detergent additives) may help reduce high temperature deposit formation for example on pistons in internal combustion engines, including for example high-temperature varnish and lacquer deposits, by helping to keep finely divided solids in suspension in the lubricating composition. Detergents may also have acid-neutralising properties. Ashless (that is non-metal containing detergents) may be present. Metal-containing detergent comprises at least one metal salt of at least one organic acid, which is called soap or surfactant. Detergents may be overbased in which the detergent comprises an excess of metal in relation to the stoichiometric amount required to neutralise the organic acid. The excess metal is usually in the form of a colloidal dispersion of metal carbonate and/or hydroxide. Examples of suitable metals include Group I and Group 2 metals, more suitably calcium, magnesium and combinations thereof, especially calcium. More than one metal may be present.

Examples of suitable organic acids include sulphonic acids, phenols (sulphurised or preferably sulphurised and including for example, phenols with more than one hydroxyl group, phenols with fused aromatic rings, phenols which have been modified for example alkylene bridged phenols, and Mannich base-condensed phenols and saligenin-type phenols, produced for example by reaction of phenol and an aldehyde under basic conditions) and sulphurised derivatives thereof, and carboxylic acids including for example, aromatic carboxylic acids (for example hydrocarbyl-substituted salicylic acids and sulphurised derivatives thereof, for example hydrocarbyl substituted salicylic acid and derivatives thereof). More than one type of organic acid may be present.

Additionally or alternatively, non-metallic detergents may be present. Suitable non-metallic detergents are described for example in U.S. Pat. No. 7,622,431.

More than one detergent may be present in the lubricating composition and/or additive concentrate.

Viscosity Index Improvers/Viscosity Modifiers

Viscosity index improvers (also called viscosity modifiers, viscosity improvers or VI improvers) impart high and low temperature operability to a lubricating composition and facilitate it remaining shear stable at elevated temperatures whilst also exhibiting acceptable viscosity and fluidity at low temperatures.

Examples of suitable viscosity modifiers include high molecular weight hydrocarbon polymers (for example polyisobutylene, copolymers of ethylene and propylene and higher alpha-olefins); polyesters (for example polymethacrylates); hydrogenated poly(styrene-co-butadiene or isoprene) polymers and modifications (for example star polymers); and esterified poly(styrene-co-maleic anhydride) polymers. Oil-soluble viscosity modifying polymers generally have number average molecular weights of at least 15000 to 1000000, preferably 20000 to 600000 as determined by gel permeation chromatography or light scattering methods.

Viscosity modifiers may have additional functions as multifunction viscosity modifiers. More than one viscosity index improver may be present.

Pour Point Depressants

Pour point depressants (also called lube oil improvers or lube oil flow improvers), lower the minimum temperature at which the lubricating composition will flow and can be poured. Examples of suitable pour point depressants include $C_8$ to $C_{18}$ dialkyl fumarate/vinyl acetate copolymers, methacrylates, polyacrylates, polyarylamides, polymethacrylates, polyalkyl methacrylates, vinyl fumarates, styrene esters, condensation products of haloparaffin waxes and aromatic compounds, vinyl carboxylate polymers, terpolymers of dialkyfumarates, vinyl esters of fatty acids and allyl vinyl ethers, wax naphthalene and the like.

More than one pour point depressant may be present.

Rust Inhibitors

Rust inhibitors generally protect lubricated metal surfaces against chemical attack by water or other contaminants. Examples of suitable rust inhibitors include non-ionic polyoxyalkylene polyols and esters thereof, polyoxyalkylene phenols, polyoxyalkylene polyols, anionic alky sulphonic acids, zinc dithiophosphates, metal phenolates, basic metal sulphonates, fatty acids and amines.

More than one rust inhibitor may be present.

Corrosion INHIBITORS

Corrosion inhibitors (also called anti-corrosive agents) reduce the degradation of metallic parts contacted with the lubricating composition. Examples of corrosion inhibitors include phosphosulphurised hydrocarbons and the products obtained by the reaction of phosphosulphurised hydrocarbon with an alkaline earth metal oxide or hydroxide, non-ionic polyoxyalkylene polyols and esters thereof, polyoxyalkylene phenols, thiadiazoles, triazoles and anionic alkyl sulphonic acids. Examples of suitable epoxidised ester corrosion inhibitors are described in US2006/0090393.

More than one corrosion inhibitor may be present.

Antioxidants

Antioxidants (sometimes also called oxidation inhibitors) reduce the tendency of oils to deteriorate in use. Evidence of such deterioration might include for example the production of varnish-like deposits on metal surfaces, the formation of sludge and viscosity increase. ZDDP's exhibit some antioxidant properties.

Examples of suitable antioxidants other than ZDDP's include alkylated diphenylamines, N-alkylated phenylenediamines, phenyl-α-naphthylamine, alkylated phenyl-α-naphthylamines, dimethylquinolines, trimethyldihydroquinolines and oligomeric compositions derived therefrom, hindered phenolics (including ashless (metal-free) phenolic compounds and neutral and basic metal salts of certain phenolic compounds), aromatic amines (including alkylated and non-alkylated aromatic amines), sulphurised alkyl phenols and alkali and alkaline earth metal salts thereof, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds (for example, copper dihydrocarbyl thio- or thiophosphate, copper salts of a synthetic or natural carboxylic acids, for example a $C_8$ to $C_{18}$ fatty acid, an unsaturated acid or a branched carboxylic acid, for example basic, neutral or acidic $Cu^1$ and/or $Cu^{1I}$ salts derived from alkenyl succinic acids or anhydrides), alkaline earth metal salts of alkylphenolthioesters, suitably having $C_5$ to $C_{12}$ alkyl side chains, calcium nonylphenol sulphide, barium t-octylphenyl sulphide, dioctylphenylamine, phosphosulphised or sulphurised hydrocarbons, oil soluble phenates, oil soluble sulphurised phenates, calcium dodecylphenol sulphide, phosphosulphurised hydrocarbons, sulphurised hydrocarbons, phosphorus esters, low sulphur peroxide decomposers and the like.

More than one anti-oxidant may be present. More than one type of anti-oxidant may be present.

Antifoams

Anti-foams (sometimes also called anti-foaming agents) retard the formation of stable foams. Examples of suitable anti-foam agents include silicones, organic polymers, siloxanes (including poly siloxanes and (poly)dimethyl siloxanes, phenyl methyl siloxanes), acrylates and the like.

More than one anti-foam may be present.

Seal Swell Agents

Seal swell agents (sometimes also called seal compatibility agents or elastomer compatibility aids) help to swell elastomeric seals for example by causing a reaction in the fluid or a physical change in the elastomer. Examples of suitable seal swell agents include long chain organic acids, organic phosphates, aromatic esters, aromatic hydrocarbons, esters (for example butylbenzyl phthalate) and polybutenyl succinic anhydride.

More than one seal swell agent may be present.

Other Additives

Examples of other additives that may be present in the lubricating composition and/or additive concentrate include extreme pressure additives (including metallic, non-metallic, phosphorus containing, non-phosphorus containing, sulphur containing and non-sulphur containing extreme pressure additives), surfactants, demulsifiers, anti-seizure agents, wax modifiers, lubricity agents, anti-staining agents, chromophoric agents and metal deactivators.

Some additives may exhibit more than one function.

The amount of demulsifier, if present, might be higher than in conventional lubricating compositions to off-set any emulsifying effect of the compound represented by structural formula (I).

Solvent

The additive concentrate for a lubricating composition may comprise solvent. Examples of suitable solvents include highly aromatic, low viscosity base stocks, for example 100N, 60 N and 100SP base stocks.

The representative suitable and more suitable independent amounts of additives (if present) in the lubricating composition are given in Table 2. The concentrations expressed in Table 2 are by weight of active additive compounds that is, independent of any solvent or diluent.

More than one of each type of additive may be present. Within each type of additive, more than one class of that type of additive may be present. More than one additive of each class of additive may be present. Additives may suitably be supplied by manufacturers and suppliers in solvent or diluents.

TABLE 2

| | Lubricant composition | |
|---|---|---|
| ADDITIVE TYPE | Suitable amount (actives), (by weight) | More suitable amount (actives), if present (by weight) |
| Anti-wear compound represented by structural formula (I) | 0.02 to 5% | 0.1 to 2.5% |
| Phosphorus-containing anti-wear additives | corresponding to 0 or 10 to 6000 ppm P | corresponding to 10 to 1000 ppm P |
| Molybdenum-containing anti-wear additives | corresponding to 0 or 10 to 1000 ppm Mo | corresponding to 40 to 600 ppm Mo |

TABLE 2-continued

| | Lubricant composition | |
|---|---|---|
| ADDITIVE TYPE | Suitable amount (actives), (by weight) | More suitable amount (actives), if present (by weight) |
| Boron-containing anti-wear additives | corresponding to 0 or 10 to 250 ppm B | corresponding to 50 to 100 ppm B |
| Friction modifiers | 0 or 0.01 to 5% | 0.01 to 1.5% |
| Molybdenum-containing friction modifiers | corresponding to 0 or 10 to 1000 ppm Mo | corresponding to 400 to 600 ppm Mo |
| Dispersants | 0 or 0.1 to 20% | 0.1 to 8% |
| Detergents | 0 or 0.01 to 6% | 0.01 to 4% |
| Viscosity index improvers | 0 or 0.01 to 20% | 0.01 to 15% |
| Pour point depressants | 0 or 0.01 to 5% | 0.01 to 1.5% |
| Corrosion and/or rust inhibitors | 0 or 0.01 to 5% | 0.01 to 1.5% |
| Anti-oxidants | 0 or 0.1 to 10% | 0.5 to 5% |
| Antifoams containing silicon | corresponding to 0 or 1 to 20 ppm Si | corresponding to 1 to 10 ppm Si |

Lubricating Composition Applications.

In at least some examples the compound represented by structural formula (I) is used as an anti-wear additive in a non-aqueous lubricating composition and/or in a fuel composition.

The compound represented by structural formula (I) may be used as an anti-wear additive in a lubricating composition that may be used, for example to lubricate the crankcase of an internal combustion engine which may be used for example in automotive applications.

In at least some examples the compound represented by structural formula (I) is used as an anti-wear additive in a lubricating composition which may be used, for example to lubricate the cylinder of an internal combustion engine, which for example, may be a two-stroke diesel crosshead engine and which may be used for example, in marine applications and/or land-based power generation plants.

In at least some examples the compound represented by structural formula (I) is used as an anti-wear additive in a lubricating composition which is a functional fluid, for example a metalworking fluid which may be used to lubricate metals during machining, rolling and the like. Suitably, the lubricating composition is a lubricating composition according to the present invention.

In at least some examples the compound represented by structural formula (I) is used as an anti-wear additive in a lubricating composition which is a power transmission fluid for example useful as an automatic transmission fluid, a fluid in a clutch (for example a dual clutch), a gear lubricating composition, or in other automotive applications and the like. Suitably, the lubricating composition is a lubricating composition according to the present invention.

In at least some examples the additive and lubricating composition are used in aviation lubricating composition applications.

In at least some examples the compound represented by structural formula (I) is used as an anti-wear additive in a lubricating composition suitable for use in turbine lubrication.

In at least some examples the compound represented by structural formula (I) is used as an anti-wear additive in a non-aqueous lubricating composition and/or in a fuel composition used to lubricate a solid surface, including for example metallic surfaces and non-metallic surfaces. Suitable metallic surfaces include surfaces of ferrous based materials, for example cast iron and steels; surfaces of aluminium-based solids, for example aluminium-silicon alloys; surfaces of metal matrix compositions; surfaces of copper and copper alloys; surfaces of lead and lead alloys; surfaces of zinc and zinc alloys; and surfaces of chromium-plated materials. Suitable non-metallic surfaces include surfaces of ceramic materials; surfaces of polymer materials; surfaces of carbon-based materials; and surfaces of glass. Other surfaces which may be lubricated include surfaces of coated materials for example surfaces of hybrid materials for example metallic materials coated with non-metallic materials and non-metallic materials coated with metallic materials; surfaces of diamond-like carbon coated materials and SUMEBore™ materials for example as described in Sultzer technical review April 2009 pages 11-13.

In at least some examples the compound represented by structural formula (I) is used in a non-aqueous lubricating composition and/or in a fuel composition to lubricate a surface at any typical temperature which might be encountered in a lubricating environment, for example at a temperature such as may be encountered in an internal combustion engine, for example a temperature in the range of ambient to 250° C., e.g. 90 to 120° C. Typically ambient temperature may be 20° C., but may be less than 20° C., for example 0° C.

Internal Combustion Engine Lubrication.

In at least some examples the compound represented by structural formula (I) is used as an anti-wear additive in a lubricating composition which may be used to lubricate an internal combustion engine, for example as a crankcase lubricating composition. Suitable engines include spark-ignition, internal combustion engines and compression-ignition, internal combustion engines. In at least some examples the internal combustion engine is a spark-ignition internal combustion engine used in automotive or aviation applications. In at least some examples the internal combustion engine is a two-stroke compression-ignition engine and the compound represented by structural formula (I) is used as an anti-wear additive in a system oil lubricating composition and/or a cylinder oil lubricating composition used to lubricate the engine. The two-stroke compression-ignition engine may be used in marine applications and/or in land-based power generation plants.

In the method of lubricating an internal combustion engine, the compound represented by structural formula (I) may be present in a lubricating composition used to lubricate the engine, for example to lubricate the crankcase of the engine. Suitably, such a lubricating composition is a lubricating composition according to the present invention.

In at least some examples the compound represented by structural formula (I) is added to the lubricating composition used to the lubricate the engine by slow release of the additive into the lubricating composition—for example by contacting the lubricating composition with a gel comprising the additive, for example as described in U.S. Pat. No. 6,843,916 and international PCT patent application publication WO 2008/008864 and/or by controlled release of the additive, for example when the back pressure of lubricating composition passing through a filter exceeds a define back pressure, for example as described in international PCT patent application publication WO2007/148047.

Additionally, or alternatively the compound represented by structural formula (I) may be present in the fuel for an internal combustion engine. In use, the compound represented by structural formula (I) may pass with or without fuel into a lubricating composition used to lubricate the engine, for example as a crankcase lubricating composition and thereby provide antiwear benefits to the lubricating composition and to the engine.

Thus according to another aspect of the present invention, there is provided a fuel composition for an internal combustion engine which composition comprises a major amount of a liquid fuel and a minor amount at a concentration of up to 500 ppm by weight of at least one compound represented by the structural formula (I):

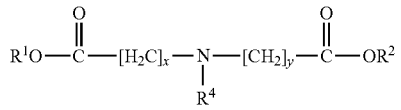

(I)

wherein $R^4$ represents H or a $C_1$ to $C_9$ hydrocarbyl group or

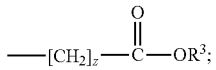

x, y and z are independently integers in the range 1 to 6; and $R^1$, $R^2$ and $R^3$ each independently represent a $C_1$ to $C_{10}$ hydrocarbyl or substituted hydrocarbyl group in which:

when the fuel is a fuel for a compression ignition internal combustion engine, $R^1$, $R^2$ and $R^3$ each independently represent a $C_1$ to $C_{10}$ hydrocarbyl or substituted hydrocarbyl group, and when the fuel is a fuel for a spark ignition internal combustion engine the composition is free of added methyl cyclopentadienyl manganese tricarbonyl and $R^1$, $R^2$ and $R^3$ each independently represent a methyl, ethyl, n-propyl, iso-propyl, n-butyl, iso-butyl or tert-butyl group, or a $C_1$ to $C_{10}$ substituted hydrocarbyl group.

In at least some examples the engine is a spark-ignition, internal combustion engine, or a compression-ignition, internal combustion engine. In at least some examples the engine is a homogeneous charge compression ignition internal combustion engine. Suitable internal combustion engines include a spark-ignition internal combustion engines that are used in automotive or aviation applications. In at least some examples the internal combustion engine is a two-stroke compression-ignition engine, for example as used in marine applications.

The compound represented by structural formula (I) is present in the fuel at a concentration of up to 500 ppm by weight, for example 20 to 200 ppm by weight or 50 to 100 ppm by weight.

Typically, the rate of ingress of fuel into crankcase lubricating composition is higher for spark-ignition internal combustion engines than for compression-ignition engines. However, the rate at which fuel ingresses into the crankcase lubricating composition for compression-ignition engines may depend and may increase depending upon the use of post-injection strategies for operation of the engine.

The compound represented by structural formula (I) present in the fuel composition may reduce wear in the fuel system of the engine, for example in the fuel pump.

Fuels

Suitable liquid fuels, particularly for internal combustion engines include hydrocarbon fuels, oxygenate fuels and combinations thereof. Hydrocarbon fuels may be derived from mineral sources and/or from renewable sources such as biomass (e.g. biomass-to-liquid sources) and/or from gas-to-liquid sources and/or from coal-to-liquid sources. Suitable sources of biomass include sugar (e.g. sugar to diesel fuel) and algae. Suitable oxygenate fuels include alcohols for example, straight and/or branched chain alkyl alcohols having from 1 to 6 carbon atoms, esters for example, fatty acid alkyl esters and ethers, for example methyl tert butyl ether. Suitable fuels may also include LPG-diesel fuels (LPG being liquefied petroleum gas). The fuel composition may be an emulsion. However, suitably, the fuel composition is not an emulsion.

Suitable fatty acid alkyl esters include methyl, ethyl, propyl, butyl and hexyl esters. Usually, the fatty acid alkyl ester is a fatty acid methyl ester. The fatty acid alkyl ester may have 8 to 25 carbon atoms, suitably, 12 to 25 carbon atoms, for example 16 to 18 carbon atoms. The fatty acid may be saturated or unsaturated. Usually, the fatty acid alkyl ester is acyclic. Fatty acid alkyl esters may be prepared by esterification of one or more fatty acids and/or by transesterification of one or more triglycerides of fatty acids. The triglycerides may be obtained from vegetable oils, for example, castor oil, soyabean oil, cottonseed oil, sunflower oil, rapeseed oil (which is sometimes called canola oil), Jatropha oil or palm oil, or obtained from tallow (for example sheep and/or beef tallow), fish oil or used cooking oil. Suitable fatty acid alkyl esters include rapeseed oil methyl ester (RME), soya methyl ester or combinations thereof.

The fuel composition according to the present invention may be prepared by admixing in one or more steps a hydrocarbon fuel, an oxygenate fuel or a combination thereof with an effective amount of at least one compound represented by structural formula (I) and optionally at least one other fuel additive.

The method of preparing a fuel composition and the method of improving the antiwear properties of a liquid fuel may comprise admixing in one or more steps said liquid fuel (which may be for example a hydrocarbon fuel, an oxygenate fuel or a combination thereof) with an effective amount of compound represented by structural formula (I) and optionally at least one other fuel additive.

The liquid fuel may be admixed with at least one additive in one or more steps by methods known in the art. The additives may be admixed as one or more additive concentrates or part additive package concentrates, optionally comprising solvent or diluent. The hydrocarbon fuel, oxygenate fuel or combination thereof may be prepared by admixing in one or more steps by methods known in the art, one or more base fuels and components therefor, optionally with one or more additives and/or part additive package concentrates. The additives, additive concentrates and/or part additive package concentrates may be admixed with the fuel or components therefor in one or more steps by methods known in the art.

Fuels and Concentrates for Compression-Ignition Engines.

According to another aspect of the present invention, there is provided a fuel composition for a compression ignition internal combustion engine which composition comprises a major amount of a liquid fuel and a minor amount at a concentration of up to 500 ppm by weight of at least one compound represented by the structural formula (I):

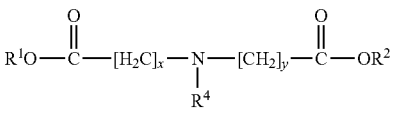

(I)

wherein $R^4$ represents H or a $C_1$ to $C_9$ hydrocarbyl group or

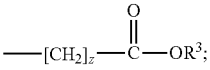

x, y and z are independently integers in the range 1 to 6; and $R^1$, $R^2$ and $R^3$ each independently represent a $C_1$ to $C_{10}$ hydrocarbyl or substituted hydrocarbyl group This fuel composition is suitable for use in an internal combustion engine which is a compression-ignition internal combustion engine, suitably a direct injection diesel engine, for example of the rotary pump, in-line pump, unit pump, electronic unit injector or common rail type, or in an indirect injection diesel engine. The fuel composition may be suitable for use in heavy and/or light duty diesel engines.

The fuel composition for compression-ignition internal combustion engines may have a sulphur content of up to 500 ppm by weight, for example, up to 15 ppm by weight or up to 10 ppm by weight. Suitably, the fuel composition for compression-ignition internal combustion engines meets the requirements of for example, the EN590 standard, for example as set out in BS EN 590:2009.

Suitable oxygenate components in the fuel composition for compression-ignition internal combustion engines include fatty acid alkyl esters, for example fatty acid methyl esters. The fuel may comprise one or more fatty acid methyl esters complying with EN 14214 at a concentration of up to 7% by volume. Oxidation stability enhancers may be present in the fuel composition comprising one or more fatty acid alkyl or methyl esters, for example at a concentration providing an action similar to that obtained with 1000 mg/kg of 3,5-di-tert-butyl-4-hydroxy-toluol (also called butylated hydroxyl-toluene or BHT). Dyes and/or markers may be present in the fuel composition for compression-ignition internal combustion engines.

The fuel composition for compression-ignition internal combustion engines may have one or more (for example all) of the following, for example, as defined according to BS EN 590:2009:—a minimum cetane number of 51.0, a minimum cetane index of 46.0, a density at 15° C. of 820.0 to 845.0 kg/m$^3$, a maximum polycyclic aromatic content of 8.0% by weight, a flash point above 55° C., a maximum carbon residue (on 10% distillation) of 0.30% by weight, a maximum water content of 200 mg/kg, a maximum contamination of 24 mg/kg, a class1 copper strip corrosion (3 h at 50° C.), a minimum oxidation stability limit of 20 h according to EN 15751 and a maximum oxidation stability limit of 25 g/m$^3$ according to EN ISO 12205, a maximum limit for lubricity corrected wear scar diameter at 60° C. of 460 μm, a minimum viscosity at 40° C. of 2.00 mm$^2$/s and a maximum viscosity at 40° C. of 4.50 mm$^2$/s, <65% by volume distillation recovery at 250° C., a minimum distillation recovery at 350° C. of 85% by volume and a maximum of 95% by volume recovery at 360° C.

The fuel composition and the additive concentrate for a fuel composition suitable for use in a compression-ignition internal combustion engine may further comprise at least one friction modifier. Such friction modifiers include compounds described herein as friction modifiers for lubricating compositions and additive concentrates for lubricating compositions.

The fuel composition and the additive concentrate for a fuel composition suitable for use with a compression-ignition internal combustion engine may further comprise at least one lubricity additive. Suitable lubricity additives include tall oil fatty acids, mono- and di-basic acids and esters.

The fuel composition and the additive concentrate for a fuel composition suitable for use in a compression-ignition internal combustion engine may further comprise independently one or more cetane improver, one or more detergent, one or more anti-oxidant, one or more anti-foam, one or more demulsifier, one or more cold flow improver, one or more pour point depressant, one or more biocide, one or more odorant, one or more colorant (sometimes called dyes), one or more marker, one or more spark aiders and/or combinations of one or more thereof. Other suitable additives which may be present include thermal stabilizers, metal deactivators, corrosion inhibitors, antistatic additives, drag reducing agents, emulsifiers, dehazers, anti-icing additives, antiknock additives, anti-valve-seat recession additives, surfactants and combustion improvers, for example as described in EP-2107102-A.

In at least some examples the additive concentrate for a fuel composition for a compression-ignition internal combustion engine comprises solvent. Suitable solvents include carrier oils (for example mineral oils), polyethers (which may be capped or uncapped), non-polar solvents (for example toluene, xylene, white spirits and those sold by Shell companies under the trade mark "SHELLSOL"), and polar solvents (for example esters and alcohols e.g. hexanol, 2-ethylhexanol, decanol, isotridecanol and alcohol mixtures, for example those sold by Shell companies under the trade mark "LINEVOL", e.g. LINEVOL 79 alcohol which is a mixture of $C_{7-9}$ primary alcohols, or a $C_{12-14}$ alcohol mixture which is commercially available.

Suitable cetane improvers include 2-ethyl hexyl nitrate, cyclohexyl nitrate and di-tert-butyl peroxide. Suitable anti-foams include siloxanes. Suitable detergents include polyolefin substituted succinimides and succinamides of polyamines, for example polyisobutylene succinimides, polyisobutylene amine succinimides, aliphatic amines, Mannich bases and amines and polyolefin (e.g. polyisobutylene) maleic anhydride. Suitable antioxidants include phenolic antioxidants (for example 2,6-di-tert-butylphenol) and aminic antioxidants (for example N,N'-di-sec-butyl-α-phenylenediamine). Suitable anti-foaming agents include polyether-modified polysiloxanes.

The representative suitable and more suitable independent amounts of additives (if present) in the fuel composition suitable for a compression-ignition engine are given in Table 3. The concentrations expressed in Table 3 are by weight of active additive compounds that is, independent of any solvent or diluent.

The additives in the fuel composition suitable for use in compression-ignition internal combustion engines are suitably present in a total amount in the range of 100 to 1500 ppm by weight. Therefore, the concentrations of each additive in an additive concentrate will be correspondingly higher than in the fuel composition, for example by a ratio of 1:0.0002 to 0.0015. The additives may be used as part-packs, for example part of the additives (sometimes called refinery additives) being added at the refinery during manufacture of a fungible fuel and part of the additives (sometimes called terminal or marketing additives) being added at a terminal or distribution point. The compound represented by structural formula (I) may suitably be added or used as a refinery or marketing additive, for example as a marketing additive at a terminal or distribution point.

TABLE 3

| Additive type | Fuel composition for compression-ignition internal combustion engine: Suitable amount (actives), if present (ppm by weight) | More suitable amount (actives), if present (ppm by weight) |
|---|---|---|
| Anti-wear compound represented by structural formula (I) | 20 to 500 | 20 to 200 |
| Lubricity additives | 1 to 200 | 50 to 200 |
| Cetane improvers | 50 to 2000 | 100 to 1200 |
| Detergents | 20 to 300 | 50 to 200 |
| Anti-oxidants | 1 to 100 | 2 to 50 |
| Anti foams | 1 to 50 | 5 to 20 |
| Demulsifiers | 1 to 50 | 5 to 25 |
| Cold flow improvers | 10 to 500 | 50 to 100 |

Fuels and Concentrates for Spark-Ignition Engines.

According to another aspect of the present invention, there is provided a fuel composition for a spark ignition internal combustion engine which composition is free of added methyl cyclopentadienyl manganese tricarbonyl and comprises a major amount of a liquid fuel and a minor amount at a concentration of up to 500 ppm by weight of at least one compound represented by the structural formula (I):

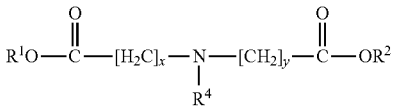

(I)

wherein $R^4$ represents H or a $C_1$ to $C_9$ hydrocarbyl group or

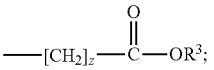

x, y and z are independently integers in the range 1 to 6; and $R^1$, $R^2$ and $R^3$ each independently represent a methyl, ethyl, n-propyl, iso-propyl, n-butyl, iso-butyl or tert-butyl group, or a $C_1$ to $C_{10}$ substituted hydrocarbyl group.

This fuel composition is suitable for use in an internal combustion engine which is a spark-ignition internal combustion engine.

The fuel composition for spark-ignition internal combustion engines may have a sulphur content of up to 50.0 ppm by weight, for example up to 10.0 ppm by weight.

The fuel composition for spark-ignition internal combustion engines may be leaded or unleaded.

The fuel composition for spark-ignition internal combustion engines may meet the requirements of EN 228, for example as set out in BS EN 228:2008. The fuel composition for spark-ignition internal combustion engines may meet the requirements of ASTM D 4814-09b.

The fuel composition for spark-ignition internal combustion engines may have one or more (for example all) of the following, for example, as defined according to BS EN 228:2008:—a minimum research octane number of 95.0, a minimum motor octane number of 85.0 a maximum lead content of 5.0 mg/1, a density of 720.0 to 775.0 kg/m$^3$, an oxidation stability of at least 360 minutes, a maximum existent gum content (solvent washed) of 5 mg/100 ml, a class 1 copper strip corrosion (3 h at 50° C.), clear and bright appearance, a maximum olefin content of 18.0% by weight, a maximum aromatics content of 35.0% by weight, and a maximum benzene content of 1.00% by volume.

Suitable oxygenate components in the fuel composition for spark-ignition internal combustion engines include straight and/or branched chain alkyl alcohols having from 1 to 6 carbon atoms, for example methanol, ethanol, n-propanol, n-butanol, isobutanol, tert-butanol. Suitable oxygenate components in the fuel composition for spark-ignition internal combustion engines include ethers, for example having 5 or more carbon atoms. The fuel composition may have a maximum oxygen content of 2.7% by mass. The fuel composition may have maximum amounts of oxygenates as specified in EN 228, for example methanol: 3.0% by volume, ethanol: 5.0% by volume, iso-propanol: 10.0% by volume, iso-butyl alcohol: 10.0% by volume, tert-butanol: 7.0% by volume, ethers ($C_5$ or higher): 10% by volume and other oxygenates (subject to suitable final boiling point): 10.0% by volume. The fuel composition may comprise ethanol complying with EN 15376 at a concentration of up to 5.0% by volume.

The fuel composition and the additive concentrate for a fuel composition suitable for use in a spark-ignition internal combustion engine may further comprise at least one friction modifier. Such friction modifiers include compounds described herein as friction modifiers for lubricating compositions and additive concentrates for lubricating compositions.

The fuel composition and the additive concentrate for a fuel composition suitable for use in a spark-ignition internal combustion engine may further comprise independently one or more detergent, one or more octane improver, one or more friction modifier, one or more anti-oxidant, one or more valve seat recession additive, one or more corrosion inhibitor, one or more anti-static agent, one or more odorant, one or more colorant, one or more marker and/or combinations of one or more thereof.

The additive concentrate for a fuel composition for a spark-ignition internal combustion engine may comprise solvent. Suitable solvents include polyethers and aromatic and/or aliphatic hydrocarbons, for example heavy naphtha e.g. Solvesso (Trade mark), xylenes and kerosine.

Suitable detergents include poly isobutylene amines (PIB amines) and polyether amines.

Suitable non-metallic octane improvers include N-methyl aniline. The gasoline is free of added methyl cyclopentadienyl manganese tricarbonyl (MMT) which is a known metallic octane improver. Suitably, the gasoline is free of all added metallic octane improvers including methyl cyclopentadienyl manganese tricarbonyl (also sometimes referred to as MMT) and other metallic octane improvers including for example ferrocene and tetra ethyl lead.

Suitable anti-oxidants include phenolic anti-oxidants (for example 2,4-di-tert-butylphenol and 3,5-di-tert-butyl-4-hydroxyphenylpropionic acid) and aminic anti-oxidants (for example para-phenylenediamine, dicyclohexylamine and derivatives thereof).

Suitable corrosion inhibitors include ammonium salts of organic carboxylic acids, amines and heterocyclic aromatics, for example alkylamines, imidazolines and tolyltriazoles.

Valve seat recession additives may be present at a concentration of up to 15000 ppm by weight, for example up to 7500 ppm by weight.

The representative suitable and more suitable independent amounts of additives (if present) in the fuel composition suitable for a spark-ignition engine are given in Table 4. The concentrations expressed in Table 4 are by weight of active additive compounds that is, independent of any solvent or diluent.

The additives in the fuel composition suitable for use in spark-ignition internal combustion engines are suitably present in a total amount in the range of 20 to 25000 ppm by weight. Therefore, the concentrations of each additive in an additive concentrate will be correspondingly higher than in the fuel composition, for example by a ratio of 1:0.00002 to 0.025. The additives may be used as part-packs, for example part of the additives (sometimes called refinery additives) being added at the refinery during manufacture of a fungible fuel and part of the additives (sometimes called terminal or marketing additives) being added at a terminal of distribution point. The compound represented by structural formula (I) may suitably be added or used as a refinery or marketing additive, preferably as a marketing additive for example at a terminal or distribution point.

TABLE 4

| | Fuel composition for spark-ignition internal combustion engine | |
|---|---|---|
| Additive type | Suitable amount (actives), if present (ppm by weight) | More suitable amount (actives), if present (ppm by weight) |
| Anti-wear compound represented by structural formula (I) | 20 to 500 | 20 to 200 |
| Friction modifiers | 10 to 500 | 25 to 150 |
| Detergents | 10 to 2000 | 50 to 300 |
| Non-metallic octane improvers | 50 to 20000 | |
| Anti-oxidants | 1 to 100 | 10 to 50 |
| Anti-static agents | 0.1 to 5 | 0.5 to 2 |

The invention will now be described by way of example only with reference to the following experiments and examples in which examples according to the present invention are labelled numerically as Example 1, Example 2 etc. and experiments not according to the present invention are labelled alphabetically as Experiment A, Experiment B etc.

Preparation of Anti-Wear Compounds Represented by Structural Formula (I).

Source of Di-Ethyliminodiacetate

Di-ethyliminodiacetate (reference AW1) is a compound represented by structural formula (I) in which x=y=1, $R^1$ and $R^2$ each represent an ethyl group and $R^4$ represents H. This compound was purchased from Sigma Aldrich.

Preparation of Di-Tert-Butyl Iminodiacetate

Di-tert-butyliminodiacetate (reference AW2) is a compound represented by structural formula (I) in which x=y=1, $R^1$ and $R^2$ each represent a tert-butyl group and $R^4$ represents H.

This was prepared by hydrogenating di-tert-butyliminobenzyldiacetate (5 g (0.015 m) by stirring in industrial methylated spirit (25 ml) under an atmosphere of hydrogen at room temperature for 24 hours in the presence of palladium on carbon (100 mg, 10%) catalyst. After the reaction TLC (thin layer chromatography) showed no starting material present.

The catalyst was filtered off through a celite bed and the solvent removed to yield a pale brown oil which solidified overnight (Yield 3.29 g (90%).

The di-tert-butyliminobenzyldiacetate had previously been prepared by dissolving benzylamine (9.8 g, 0.0915 m) in acetonitrile (250 ml). Then freshly ground potassium carbonate (40 g) was added with stirring at room temperature followed by butyl bromoacetate (35.7 g, 0.183 m) in acetonitrile (50 ml). The reaction mixture was stirred overnight at room temperature. The solids were removed by filtration and the cake washed with acetonitrile. The filtrates were reduced by rotary evaporation at 40° C. giving an oil which solidified overnight to give a white solid (yield 31.3 g (102%)).

Preparation of Triethyliminotriacetate.

Triethyliminotriacteate (reference AW3) is a compound represented by structural formula (I) in x=y=1, $R^1$ and $R^2$ each represent an ethyl group and $R^4$ represents:

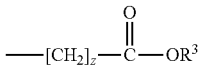

wherein z=1 and $R^3$ represents an ethyl group.

This compound was prepared as follows. To a solution of 2,2',2"-nitrilotriacetic acid (25.0 g, 0.1308 mol., 1.0 eq.) in dry ethanol (250 ml) thionyl chloride (56.0 g, 0.4712 mol., 3.6 eq.) was added drop wise at 0° C. with stirring under nitrogen. After completion of the addition it was heated to 70° C. for 12 hours. The reaction was monitored by TLC (7:3 petroleum ether:ethyl acetate). After completion of the reaction, the reaction mixture was concentrated. The reaction mass was extracted with ethyl acetate (2×250 ml). The organic phase was washed with water (1×250 ml), $NaHCO_3$ (1×250 ml) & brine (1×250 ml). The organic layer was dried over $Na_2SO_4$, and concentrated under vacuum. The crude product was purified through column chromatography using 5% ethyl acetate in petroleum ether as eluent system to get the required product (81%). It was characterized by $^1$H NMR.

Preparation of Diethyl(Imino-Methyl)Diacetate

Diethyl(imino-methyl)diacetate (reference AW4) is a compound represented by structural formula (I) in which x=y=1, $R^1$ and $R^2$ each represent an ethyl group and $R^4$ represents methyl. This compound was prepared as follows. A solution of methylimino diacetic acid (20.0 g, 0.136 mol., 1.0 eq.) in dry ethanol (200 ml) was cooled to 0° C. Concentrated HCl (9.93 g, 0.272 mol., 2.0 eq.) was added drop wise with stirring under nitrogen. The reaction mixture was refluxed at 70° C. for 12 hours. The reaction was monitored by TLC. After completion of the reaction, the reaction mixture was concentrated. Reaction mass was extracted with ethyl acetate (2×250 ml). The organic phase was washed with water (1×250 ml), $NaHCO_3$ (1×250 ml) & brine (1×250 ml). The organic layer was dried over $Na_2SO_4$, and concentrated under vacuum. The crude product was purified through column chromatography using 0.5% methanol in $CHCl_3$ as eluent system to get the required product (80%). It was characterized by $^1$H NMR.

Preparation of Lubricating Compositions.

A lubricating composition (LUB A) was prepared by admixing components to produce a lubricating composition comprising an additive package (10.21% by weight), a viscosity modifier (4% by weight) and Yubase 4 and Yubase 6 base oils (balance). The additive package comprised a conventional non-borated dispersant, calcium sulfonate and phenate detergents, phenolic and aminic anti-oxidants, anti-foam and Group III base oil.

A lubricating composition (LUB B) was prepared in the same way and with the same composition as LUB A, except that it additionally comprised zinc dialkyl dithiophosphate in an amount corresponding to a phosphorus concentration in the lubricating composition of 400 ppm P.

Lubricating compositions LUB A and LUB B are not according to the present invention because the lubricating compositions do not comprise compounds represented by structural formula (I). The lubricating compositions LUB A and LUB B were formulated to 0W20 grade, modelling a typical lubricating composition which might be used to lubricate an internal combustion engine (spark or compression ignition), for example as a crankcase lubricant. Properties of LUB A and LUB B are given in Tables 5 and 6. Lubricating compositions (Examples 1 to 7) comprising compounds represented by structural formula (I) together with LUB A or LUB B were prepared by admixing components to produce lubricating compositions having compositions shown in Tables 5 and 6.

Wear testing using Cameron Plint (CP) test procedures as described below was undertaken on the lubricating compositions and results are given in Tables 5 to 6.

Cameron Plint Wear Tests.

Cameron Plint (CP) wear tests were undertaken for lubricating compositions prepared as described above.

A Cameron Plint rig wear test was used to simulate reciprocating boundary friction and produce wear at higher temperatures (100° C.). The apparatus was set up in a pin on plate configuration. The pin was reciprocated along the plate at a frequency of 25 Hz, stroke length of 2.3 mm and with an applied pressure of 150N. Oil was fed into the contact area at a rate of 3 ml/hr. Standard steel B01 Flat Plate and EN31 Roller plint components were used in these tests. After 21 hour tests, the samples were measured on a Talysurf™ machine which provides a wear scar profile, from which the wear volume was calculated and the wear rate derived therefrom. The results for LUB A and LUB B are shown in Tables 5 and 6 respectively.

The Cameron Plint wear tests show a significant improvement in wear rate for the lubricating compositions comprising compounds represented by structural formula (I), for example AW1, AW2, AW3 and AW4 in both the presence and absence of added zinc dialkyl dithiophosphate (ZDDP).

Cylinder Lubricant Applications

Experiment C and Examples 8 and 9

Di-ethyliminodiacetate (reference AW1) and di-tert-butyliminodiacetate (reference AW2) obtained as previously described, were tested for their effect on wear in a cylinder lubricating composition, such as might be used to lubricate the cylinder of a two-stroke diesel crosshead engine which may be used for example, in a marine application and/or in a land-based power generation plant.

A cylinder lubricating composition (LUB C) was prepared by admixing an additive package (21.6%) with AP/E Core BS 2500 and AP/E Core SN 600 base oils (balance). The additive package comprised a conventional polyisobutylene polyamine dispersant, calcium sulfonate and phenate detergents, anti-foam and Group I base oil.

This composition was tested in a Cameron Plint wear test as described above, by itself (Experiment C) and with 0.5% by weight AW1 and AW2 (Examples 8 and 9, respectively). The results are shown in Table 7.

The Cameron Plinth wear tests in Table 7 show an improvement in wear rate for the cylinder lubricating compositions comprising compounds represented by structural formula (I), for example AW1 and AW2.

TABLE 5

| Without ZDDP | | | Experiment A Not according to invention | Example 1 Invention | Example 2 Invention |
|---|---|---|---|---|---|
| | LUB A | no ZDDP | 100 | 99.5 | 99 |
| | AW 1 | diethyl-iminodi-acetate | | 0.5 | 1 |
| | Total | | 100 | 100 | 100 |
| | KV40 | cSt | 44.18 | 42.46 | 41.44 |
| | KV100 | cSt | 8.31 | 8.07 | 7.93 |
| | VI | | 166 | 166 | 166 |
| CP | Wear Rate | $m^3$/Nm (average of 3 to 5 runs) | 2E−16 | 4E−18 | 5E−18 |
| | Wear Volume | $mm^3$ (average of 3 to 5 runs) | 0.3 | 0.0055 | 0.0064 |
| | Max WS Depth | µm (average of 3 to 5 runs) | 45 | 3.5 | 3.0 |
| | Improvement in wear rate vs. LUB A | % | | 98 | 98 |

TABLE 7-continued

| Cylinder Lubricating Composition | | | Experiment C Not according to invention | Example 8 Invention | Example 9 Invention |
|---|---|---|---|---|---|
| | AW2 | di-tert-butyl iminodi-acetate | | | |
| | Total | | 100 | 100 | 100 |
| | KV100 | cSt | 19.5 | 19.42 | 19.40 |
| | VI | | 102 | 102 | 102 |
| CP | Wear Rate | $m^3$/Nm | 5E−17 (1) | 3E−17 (2) | 4E−17 (2) |
| | Wear Volume | $mm^3$ | 0.0888 (1) | 0.0493 (2) | 0.0730 (2) |
| | Improvement in wear rate vs. LUB C | % | | 45 | 18 |

(1) Average of 3 runs;
(2) Single run; Test variation is 5%.

Sequence IVA Engine Wear Tests.

Sequence IVA engine tests according to ASTM test method ASTM D6891 were undertaken for 0W-20 lubricating compositions. The Sequence IVA test is an industry standard test used to evaluate the camshaft wear protection of internal combustion engine lubricating compositions. The sequence IVA test may be performed according to ASTM D6891.

TABLE 6

| with ZDDP at 400 ppm P | | | Experiment B No according to invention | Example 3 Invention | Example 4 Invention | Example 5 Invention | Example 6 Invention | Example 7 Invention |
|---|---|---|---|---|---|---|---|---|
| | LUB B | (400 ppm P) | 100 | 99.5 | 99 | 99.5 | | |
| | AW 1 | Diethyliminodiacetate | | 0.5 | 1 | | | |
| | AW 2 | di-tert-butyl iminodiacetate | | | | 0.5 | | |
| | AW 3 | | | | | | 0.5 | |
| | AW 4 | | | | | | | 0.5 |
| | Total | | 100 | 100 | 100 | 100 | 100 | 100 |
| | KV40 | cSt | 44.20 | 42.77 | 41.67 | 43.32 | | |
| | KV100 | cSt | 8.28 | 8.07 | 7.93 | 8.17 | | |
| | VI | | 165 | 165 | 165 | 166 | | |
| CP | Wear Rate | $m^3$/Nm (average of 3 to 5 runs) | 3E−17 | 4E−18 | 7E−18 | 4E−18 | 3E−18 | 4E−18 |
| | Wear Volume | $mm^3$ (average of 3 to 5 runs) | 0.0370 | 0.0056 | 0.0088 | 0.0045 | 0.0044 | 0.0048 |
| | Max WS Depth | µm (average of 3 to 5 runs) | 6.2 | 2.6 | 3.3 | 4.6 | 2.0 | 1.9 |
| | Improvement in wear rate vs. LUB B | % | | 85 | 76 | 88 | 88 | 87 |

TABLE 7

| Cylinder Lubricating Composition | | | Experiment C Not according to invention | Example 8 Invention | Example 9 Invention |
|---|---|---|---|---|---|
| | LUB C | | 100 | 99.5 | 99 |
| | AW 1 | diethyl-iminodi-acetate | | 0.5 | 1 |

Example 10

A lubricating composition was prepared by admixing components to produce a lubricating composition comprising an additive package (10.21% by weight), ZDDP at a treat rate corresponding to 400 ppm phosphorus, a viscosity modifier (4% by weight), diethyliminodiacetate (AW1) (0.5% by weight) and Yubase 4 and Yubase 6 base oils (balance). The additive package comprised a conventional non-borated dispersant, a calcium sulfonate and phenate detergents, phenolic and aminic anti-oxidants, anti-foam and Group III base oil.

Diethyliminodiacetate (AW1) corresponds to a compound represented by structural formula (I)=$R^2$ represents an ethyl group, x=y=1 and $R^4$ represents H.

The lubricating composition gave a camshaft total wear of 16.8 microns in the sequence IVA engine test.

Experiment D

A lubricating composition having a composition corresponding to that used in Example 8 but without any compound represented by structural formula (I) gave a camshaft total wear of 163.1 microns in the sequence IVA engine test. This is not an example according to the present invention because a compound represented by structural formula (I) was not present in the composition.

Comparison of the result for Experiment D (camshaft total wear of 163.1 microns in the sequence IVA engine test) with the result for Example 10 (camshaft total wear of 16.8 microns in the sequence IVA engine test) shows that the use of a compound represented by structural formula (I), for example diethyliminodiacetate (AW1), provides a lubricating composition having anti-wear properties (for example as measured by the sequence IVA engine test).

Experiment E

A lubricating composition having a composition corresponding to that used in Example 10 but without any compound represented by structural formula (I) and having a ZDDP concentration corresponding to 750 ppm phosphorus gave a camshaft total wear of 62.4 microns in the sequence IVA engine test. This is not an example according to the present invention because a compound represented by structural formula (I) was not present in the composition.

A comparison of the result for Example 10 (camshaft total wear of 16.8 microns in the sequence IVA engine test) with the result for this experiment (camshaft total wear of 62.4 microns in the sequence IVA engine test) shows that the use of a compound represented by structural formula (I), for example diethyliminodiacetate (AW1), provides a lubricating composition having anti-wear properties (for example as measured by the sequence IVA engine test) at least as good as that of a lubricating composition comprising ZDDP at a higher concentration. This shows that the presence in a lubricating composition of the compound represented by structural formula (I) may assist in the performance of anti-wear additives, for example, zinc dihydrocarbyl dithiophosphate additives. This also shows that the compounds represented by structural formula (I) may be used to reduce or even eliminate the amount of ZDDP which need be used in a lubricating composition.

The results in Table 5 (without ZDDP) and in Table 6 (with ZDDP at 400 ppm P), the results in Table 7 (cylinder lubricating composition) and the results of the Sequence IVA engine wear test show that the anti-wear compounds represented by structural formula (I) exhibit anti-wear properties and so would be suitable for use for example in a non-aqueous lubricating composition, in a method of lubricating an internal combustion engine, in a method of improving the anti-wear properties of an oil of lubricating viscosity, in a method of preparing a non-aqueous lubricating composition, in an additive concentrate for a non-aqueous lubricating composition, in a fuel composition (for example for an internal combustion engine), in a method of improving the anti-wear properties of a liquid fuel, in a method of preparing a fuel composition for an internal combustion engine, in an additive concentrate for a fuel composition for an internal combustion engine and in a method of operating an internal combustion engine.

The invention claimed is:

1. A non-aqueous lubricating composition comprising a major amount of an oil of lubricating viscosity and a minor amount, in the range of 0.02% to 5% by weight, of at least one compound represented by the structural formula (I):

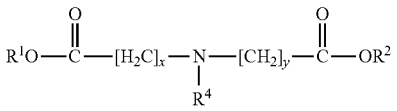

(I)

wherein $R^4$ represents H or a $C_1$ to $C_9$ hydrocarbyl group or

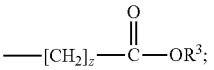

x, y and z are independently integers in the range 1 to 6; and $R^1$, $R^2$ and $R^3$ each independently represent a $C_1$ to $C_{10}$ hydrocarbyl or substituted hydrocarbyl group.

2. A non-aqueous lubricating composition as claimed in claim 1 in which in the structural formula (I), x, y and z are each 1.

3. A non-aqueous lubricating composition as claimed in claim 1 in which in the structural formula (I), $R^1$ $R^2$ and $R^3$ each independently represent a saturated hydrocarbyl group.

4. A non-aqueous lubricating composition as claimed in claim 3 in which in the structural formula (I), $R^1$ $R^2$ and $R^3$ each independently represent a methyl, ethyl, n-propyl, iso-propyl, n-butyl, iso-butyl or tert-butyl group.

5. A non-aqueous lubricating composition as claimed in claim 1 in which in the structural formula (I), $R^4$ represents H.

6. A non-aqueous lubricating composition as claimed in claim 1 in which in the structural formula (I), $R^4$ represents H; x=y=1; and $R^1$ and $R^2$ each independently represent an ethyl or tert-butyl group.

7. A non-aqueous lubricating composition as claimed in claim 1 in which in the structural formula (I), $R^4$ represents a methyl group.

8. A non-aqueous lubricating composition as claimed in claim 1 in which in the structural formula (I), $R^1$ $R^2$ and $R^3$ each independently represent a substituted hydrocarbyl group comprising at least one heteroatom which is selected from the group consisting of nitrogen, oxygen and combinations thereof.

9. A non-aqueous lubricating composition as claimed in claim 1 in which in the structural formula (I), x=y=1, $R^1$ and $R^2$ each represent an ethyl group and $R^4$ represents:

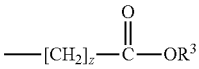

wherein z=1 and $R^3$ represents an ethyl group.

10. A fuel composition for a compression ignition internal combustion engine which composition comprises a major amount of a liquid fuel and a minor amount at a concentration of up to 500 ppm by weight of at least one compound represented by the structural formula (I):

(I)

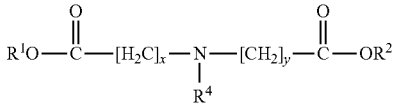

wherein $R^4$ represents H or a $C_1$ to $C_9$ hydrocarbyl group or

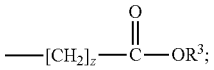

x, y and z are independently integers in the range 1 to 6; and $R^1$, $R^2$ and $R^3$ each independently represent a $C_1$ to $C_{10}$ hydrocarbyl or substituted hydrocarbyl group.

11. A fuel composition as claimed in claim 10 in which in the structural formula (I), x, y and z are each 1.

12. A fuel composition as claimed in claim 10 in which in the structural formula (I), $R^1$ $R^2$ and $R^3$ each independently represent a saturated hydrocarbyl group.

13. A fuel composition as claimed in claim 12 in which in the structural formula (I), $R^1$ $R^2$ and $R^3$ each independently represent a methyl, ethyl, n-propyl, iso-propyl, n-butyl, iso-butyl or tert-butyl group.

14. A fuel composition as claimed in claim 10 in which in the structural formula (I), $R^4$ represents H; x=y=1; and $R^1$ and $R^2$ each independently represent an ethyl or tert-butyl group.

15. A fuel lubricating composition as claimed in claim 10 in which in the structural formula (I), $R^4$ represents a methyl group.

16. A fuel composition as claimed in claim 10 in which in the structural formula (I), $R^1$ $R^2$ and $R^3$ each independently represent a substituted hydrocarbyl group comprising at least one heteroatom which is selected from the group consisting of nitrogen, oxygen and combinations thereof.

17. A fuel composition as claimed in claim 10 in which in the structural formula (I), x=y=1, $R^1$ and $R^2$ each represent an ethyl group and $R^4$ represents:

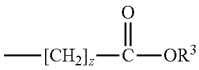

wherein z=1 and $R^3$ represents an ethyl group.

18. A fuel composition for a spark ignition internal combustion engine which composition is free of added methyl cyclopentadienyl manganese tricarbonyl and comprises a major amount of a liquid fuel and a minor amount at a concentration of up to 500 ppm by weight of at least one compound represented by the structural formula (I):

(I)

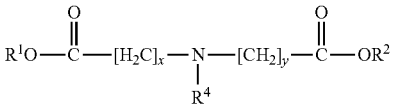

wherein $R^4$ represents H or a $C_1$ to $C_9$ hydrocarbyl group or

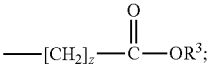

x, y and z are independently integers in the range 1 to 6; and $R^1$ $R^2$ and $R^3$ each independently represent a methyl, ethyl, n-propyl, iso-propyl, n-butyl, iso-butyl or tert-butyl group or a $C_1$ to $C_{10}$ substituted hydrocarbyl group.

19. A fuel composition as claimed in claim 18 which is free of all added metallic octane improvers.

20. A fuel composition as claimed in claim 18 in which $R^1$ $R^2$ and $R^3$ each independently represent an ethyl or tert-butyl group.

21. A fuel composition as claimed in claim 18 in which in the structural formula (I), $R^4$ represents H; x=y=1; and $R^1$ and $R^2$ each independently represent an ethyl or tert-butyl group.

* * * * *